United States Patent [19]

Gates

[11] 4,312,270

[45] Jan. 26, 1982

[54] STENCIL DUPLICATOR

[75] Inventor: Albert G. R. Gates, London, England

[73] Assignee: Gestetner Limited, England

[21] Appl. No.: 36,990

[22] Filed: May 8, 1979

[30] Foreign Application Priority Data

May 15, 1978 [GB] United Kingdom ..... 20561/78

[51] Int. Cl.[3] ..... B41L 13/08

[52] U.S. Cl. ..... 101/122

[58] Field of Search ..... 101/122–124, 101/355, 349, 350, 363, DIG. 18; 73/150 R, 150 A

[56] References Cited

U.S. PATENT DOCUMENTS

| | | | |
|---|---|---|---|
| 2,993,371 | 7/1961 | Greubel | 73/150 |
| 3,442,121 | 5/1969 | Wirz | 73/150 |
| 3,762,324 | 10/1973 | Ivary | 101/350 |
| 3,804,012 | 4/1974 | Bosshardt | 101/122 |
| 3,869,984 | 3/1975 | Toth | 73/150 |

FOREIGN PATENT DOCUMENTS

| | | | |
|---|---|---|---|
| 521113 | 5/1940 | United Kingdom | 101/122 |
| 1471196 | 4/1977 | United Kingdom | 73/150 |

*Primary Examiner*—James R. Feyrer

*Attorney, Agent, or Firm*—Lewis H. Eslinger

[57] ABSTRACT

An automatic control mechanism for the thickness of an ink layer on a duplicator cylinder employs a sensing roller mounted for movement along a path which extends both peripherally and radially of the cylinder where the ink is to be measured and thus the drag on the ink pulls the cylinder to an equilibrium position where it just maintains sufficient contact with the layer of ink to be subject to that drag whereas any further movement will move it radially away from the ink layer to lose contact. The pivoting support for the sensing roller engages a switch when an extreme position is attained and this provides an "enough ink" signal.

An adjustable biasing mechanism enables the position of the sensing roller to be additionally subject to a biasing selective manually by the operator to control ink layer thickness and another adjustment in response to the speed of rotation of the duplicator.

In one form, the sensing roller is able to skew so that a sensing switch at one end of the duplicator cylinder may be tripped before the sensing switch of the other end of the cylinder, for the purposes of providing a control which at least to some extent is responsive to local thickness of the layer. A further possibility envisages providing several different such rollers which between them cover the entire axial extent of the cylinder and thus they are each able to control the application of ink locally.

13 Claims, 4 Drawing Figures

STENCIL DUPLICATOR

The present invention relates to a stencil duplicator.

Stencil duplicators are known in which an ink pump feeds ink to the surface of a printing cylinder and this ink flow can be varied at the will of the operator. However, the ink flow variation requires careful supervision on the part of the operator and it is an object of the present invention to eliminate the need for this close operator supervision of the ink quantity and to allow for automatic control of the ink application in response to the amount of ink circulating in the duplicator.

In accordance with the present invention we provide a stencil duplicator including a cylinder on which a stencil is to be mounted for ink transfer between the surface of the cylinder and the stencil means for applying ink to the surface of said cylinder, and means for automatically controlling the quantity of ink on said cylinder, wherein said ink control means includes: a sensing roller positioned adjacent the surface of said cylinder and mounted for movement to and fro along a path extending both in a peripheral direction of the said cylinder and radially of said cylinder for contacting a layer of ink on said cylinder in use of the duplicator, and means for monitoring movement of said sensing roller along its peripheral path.

Conveniently the pivot axis of the sensing roller is eccentric with respect to the axis of rotation of the printing cylinder whereby during movement of the sensing roller, from a rest position towards a "sufficient ink" position, the gap between the sensing roller and the duplicator cylinder surface increases.

More conveniently means may be provided for adjusting the gap between the sensing roller and the surface of the duplicator cylinder for any position of the sensing roller peripherally of the cylinder.

In order that the present invention may more readily be understood the following description is given, merely by way of example, with reference to the accompanying drawings in which.

Figure 1:
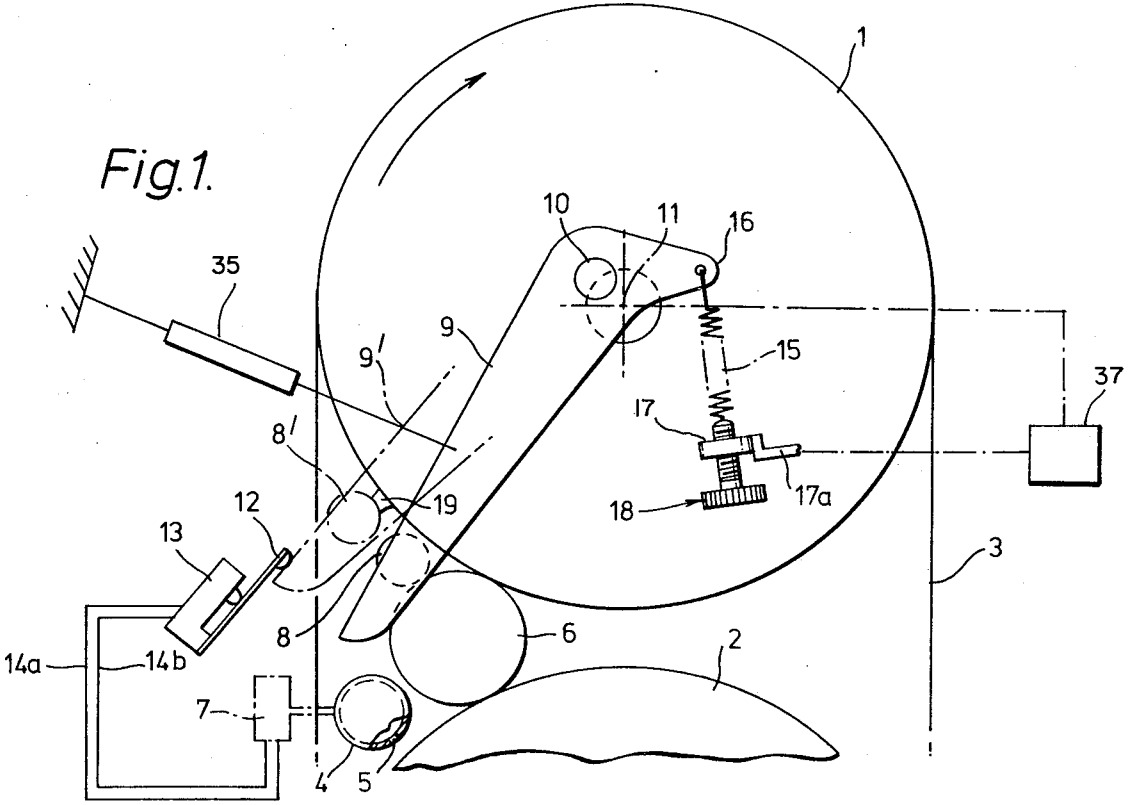
FIG. 1 is a schematic side view showing one embodiment of a stencil duplicator in accordance with the present invention.

FIG. 1 shows a twin cylinder duplicator having an upper cylinder 1 and a lower cylinder 2 with the customary ink screen 3 arranged on the two cylinders 1 and 2 in the form of a belt to carry the stencil, not shown.

Ink is applied to the cylindrical surface of the lower cylinder 2 by way of an ink distributor tube 4 having a set of ink outlets 5 (only one of which can be seen in the drawing) through which ink exudes onto the surface of the cylinder 2 to be applied to the lower cylinder 2 as, during further rotation of the cylinder, a longitudinally oscillating inking roller 6 presses the ink onto the surface of the lower cylinder 2. This same inking roller 6 is also in contact with the upper cylinder 1 and helps to transfer ink between the lower cylinder 2 and the upper cylinder 1.

Ink is pumped along the distributor 4 from an ink pump 7 supplied by an inlet pipe 7*a*, both shown purely schematically in the drawing.

In use of the duplicator, ink is transferred onto the ink screen 3 on its back surface, i.e. the inside surface of the ink screen, by virtue of the fact that the ink screen 3 is pressed onto the inky surface of both the upper and lower cylinders 1 and 2.

During use of the duplicator, ink will be consumed due to two factors. Firstly, the printed copy sheets will pick up ink from the ink screen 3, such that a copy which has a relatively high "black-to-white" density ratio of image will have a high ink consumption, whereas a copy sheet whose image has only a few lines of print or has, for any other reason, a relatively low "black-to-white" density ratio will only give rise to a low ink consumption.

A second cause of ink consumption is derived from the fact that ink is applied uniformly over the whole of the underneath or front side of the stencil, as the ink passes through the ink screen 3 from front to back, and thus although ink will only pass through the stencil at the image areas and thus the image on the outwardly facing side of the stencil will show the conventional positive display with the "black-to-white" density ratio desired of the copy sheet, the inwardly facing side or front of the stencil, lying in contact with the ink screen, will of course be uniformly inked with a relatively thick bed of ink which is sufficient to hold the stencil onto the ink screen and prevent stencil flap. Thus whenever one stencil is removed, and a fresh stencil applied, there will be a resulting depletion of the amount of ink on the duplicator as a hitherto uninked stencil is smoothed on in place of the previously inked stencil.

In the past, it has been necessary for the operator to assess the "black-to-white" density ratio of the copy sheet in order to compensate for relatively heavily inked copies by manually adjusting the rate of application of the ink and equally it has been found necessary for the operator to boost the ink supply when fitting a new stencil. With the duplicator of the present invention, it is intended that the quantity of ink on the cylinders, ink screen and stencil will be controlled automatically to remain within controlled limits.

Figure 3:
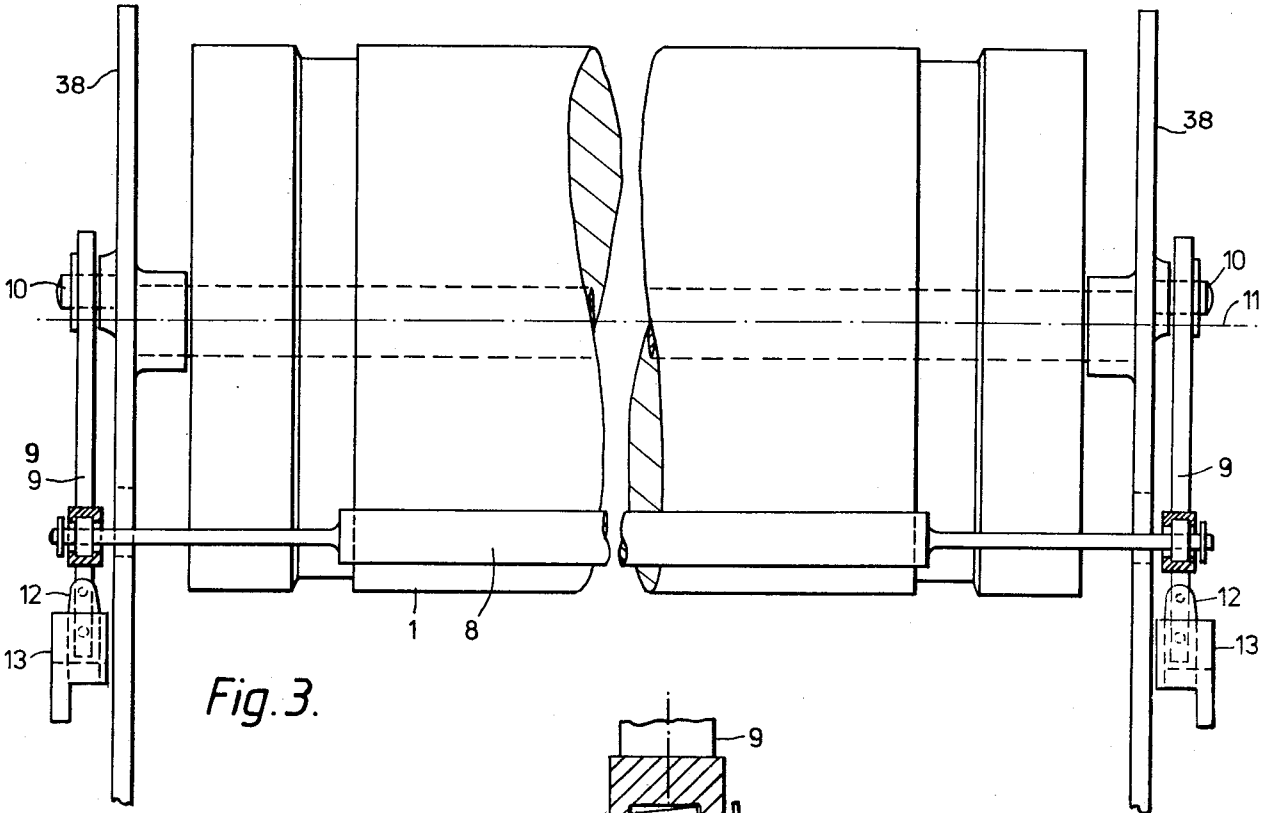
FIG. 3 is an elevational view looking from the left-hand side of FIG. 1, but showing an embodiment where the two ends of the sensing roller move independently.

The mechanism which provides this ink control facility consists of an ink sensing roller 8 extending parallel to the axis of rotation of the upper cylinder 1 and supported at its ends by a pair of swinging arms 9 which are journalled on coaxial stub shafts 10 (FIG. 3), each of the arms 9 being at a respective end of the upper duplicator cylinder 1. The stub shafts 10 of the swinging arms 9 are deliberately offset with respect to the axis of rotation 11 of the upper duplicator cylinder 1, for reasons which will be explained below.

The gravity biasing moment resulting from the weight of the two arms 9 and the roller 8 carried by them, about the stub shafts 10 causes the roller to fall onto the inking roller 6 when the duplicator is stationary.

The sensing roller 8 is, however, able to rise away from the surface of the inking roller 6 towards a position, shown in broken lines in the drawing, where one or both of the arms 9 will come into contact with the sensing finger 12 of an associated switch 13 connected, by way of conductors 14*a*, 14*b*, to the motor 7 to energise the motor at all times except when the switch sensing finger 12 or either of the switch sensing fingers has been engaged and displaced by the associated arm 9.

The offset of the common axis of stub shafts 10 for the swinging arms 9, with respect to the rotation axis 11 of the upper cylinder 1, is such that, as the roller 8 moves from its "rest" position sitting on the inking roller 6, towards its broken line position 8' where the or a switch sensing finger 12 is displaced by the associated arm 9, the sensing roller 8 will move slightly further away from the cylindrical surface of the upper cylinder 1. Because of this relationship between the angle of inclination of the arms 9 and the gap between the closest points of the surface of the sensing roller 8 and the upper cylinder 1, there will be a precise correlation between the thickness of ink able to pass between, on the one hand, the sensing roller 8 and the surface of the upper cylinder 1 and, on the other hand, the angle of inclination of the arms 9.

During rotation of the duplicator cylinder 1, the thickness of ink on the surface of the upper cylinder 1 will become such that a wedge of ink builds up in the nip between the sensing roller 8 and the upper cylinder 1 and becomes sufficiently large to drag the sensing roller 8 for orbiting in the clockwise sense about the stub shafts 10, (i.e. in a direction away from the inking roller 6 and towards the sensing finger 12 of the associated switch 13) against the gravity biasing moment of the arms 9 and sensing roller 8 about the stub shafts 10. Since the wedge of ink is a viscous body it will tend to pass through the nip between the sensing roller 8 and cylinder 1 while imposing a drag force on the roller 8 which is dependent on the thickness of ink just below the nip (i.e. in the wedge) and also the width of the nip (i.e. the angle of inclination of the arms 9). For each value of wedge thickness (which can of course be related to ink film thickness) there will be an equilibrium condition of the sensing roller 8 at a corresponding angle of inclination of arms 9. The thicker the wedge, the further the arms 9 will be from the vertical. Thus, once a "steady state" condition has been reached, with the wedge of ink supporting the sensing roller 8, the inclination of the arm 9 in position 9' can be directly related to a given thickness of ink film on the upper cylinder 1.

In order to assist the tacky ink wedge in its task of displacing the sensing roller 8, an adjustable tension spring 15 is attached between on the one hand a lug 16 on one or both of the arms 9 and on the other hand a fixed bracket 17. The end of the spring 15 is attached to the bracket 17 by way of an adjustor screw 18 which is threadedly engageable in the bracket 17 and has a peripherally knurled head so that rotation of the screw 18 allows adjustment of the positioning of the lower end of the spring. Increasing the tension in the spring 15 will make the roller 8 more easily able to rise towards the "enough ink" position 8', thereby causing earlier disenabling of the pump 7 to maintain a lower quantity of ink on the cylinders and the ink screen of the duplicator; conversely, lowering the spring tension will leave a greater unbalanced proportion of the gravity biasing moment of the arms 9 and sensing roller 8 to be overcome by the viscosity of the ink wedge and thereby give an increased quantity of ink on the duplicator cylinders 1 and 2 and ink screen 3 since the ink wedge will need to be that much thicker to force the roller 8 up into the "enough ink" position 8' to disenable the pump 7.

It is envisaged that the adjustable tension spring 15 may alternatively be linked to the conventional manually adjustable speed select linkage of the duplicator in order to compensate for different operating speeds of the duplicator.

The linking of the adjustable tension spring 15 to the speed selecting mechanism may, for example, compensate for the influence of the viscosity of the ink on the behaviour of the wedge 19 during normal printing. However, as the speed of rotation of the cylinders 1 and 2 is decreased, corresponding to a selected slower printing speed, the effect of the viscous wedge of ink between the sensing roller 8 and the duplicator cylinder 1 may be such that the wedge of ink is able more readily to become displaced through the nip between the roller 8 and the cylinder 1 for the same nip width, whereby the wedge offers a reduced clockwise moment on the sensing roller 8 and allows the roller 8 to move the anticlockwise direction about the stub shafts 10 to adopt a position closer to the inking roller 6 and also closer to the surface of the upper cylinder 1 until the wedge 19 once again builds up to a controlled level. This means that the machine would tend to run at a higher inking level for the same angle of inclination of arms 9, and consequently a much thicker ink wedge 19 will be needed before each of the arms 9 attains its position 9' to disenable the ink pump. Conversely, when the printing speed is increased the viscosity of the ink of the wedge 19 may be found to behave in such a way that the wedge 19 appears to become "harder" or "more rigid" and consequently the switch finger 12 will be more readily displaced, with the result that a generally lower level of inking on the machine will be evident.

The interlinking between the ink control system and the speed select system of the duplicator, may be achieved by mounting the bracket 17 on a moving link **17*a* of the conventional speed select linkage to the schematically illustrated conventional variable speed drive system 37 of the duplicator, so that the bracket 17 moves to expand or contract the spring 15 as the selected speed is changed. To construct such an arrangement will be well within the ability of the skilled workman in this art. By adjusting the position of the bracket 17 in response to the selected operating speed of the duplicator it is possible to ensure that the tension in the spring 15 is reduced at high operating speeds when the sensing roller 8 will be more likely, of its own accord, to attain a position which is higher along its arcuate path, and the tension in the spring 15 is increased when the machine is run slower. The geometry of the speed select control member to which bracket 17 is attached will be chosen so that precisely the correct amount of control movement of bracket 17** is obtained.

Alternatively, the bracket 17 may if desired be fixed to the machine frame and the only adjustment of the spring force may be that imposed on it by the operator in order to vary the degree of inking as a function of the black/white area ratio of the image to be printed. Such an arrangement will be readily apparent to the skilled workman in this art.

It is also envisaged that some form of damping mechanism may be incorporated since it has been observed, in operation of a duplicator in accordance with the present invention, that rather than adopt a steady position, the arms 9 carrying the sensing roller 8 tend to oscillate about their stub shafts 10 with the result that the arms 9 may make only intermittent contact with the sensing finger 12. For this purpose it may be desirable either to incorporate a mechanical damper 35 (FIG. 1) which prevents rapid fluctuations in the position of the arms 9 and ensures that the sensing finger 12 is displaced only when a steady "enough ink" or insufficient ink signal is attained, or to provide an electrical time delay system 36 (FIG. 2) in the electrical circuit linking the switch 13 with the ink pump 7 so that intermittent contact between the arm or arms 9 and the sensing finger 12 will be ignored and the "enough ink" signal will only be assumed once the sensing finger 12 has remained in its displaced position for a predetermined time interval from initial contact.

In our co-pending British patent application No. 18132/77 also filed April 12, 1978 as U.S. patent application Ser. No. 895,753, now U.S. Pat. No. 4,194,447, we have described and claimed a stencil duplicator incorporating a mechanism for automatically attaching the stencil to the ink screen of the duplicator while the cylinders are "on the run". With such a system it is particularly desirable for control of the ink to be effected automatically since so little operator intervention is required when ejecting one stencil into a "used stencil" container and attaching the next stencil to the ink screen that the operator may well overlook the fact that each time he or she changes a stencil there will of course be a resulting depletion of the ink quantity on the duplicator cylinders. Although it is envisaged that the "stencil attach" control on such a duplicator may be linked to the inking system to provide a boosting of the ink supply as a new stencil is attached, this of course has the disadvantage that no compensation is made for the variations in "black-to-white" density ratio between the various stencils used. Thus attaching a new stencil having a low "black-to-white" density ratio in place of an old stencil with a high "black-to-white" ratio would give rise to surplus ink and bad copy prints. It is therefore considered particularly desirable for the ink control system described above to be incorporated on a duplicator in accordance with the invention of our said British patent application No. 18132/77.

As indicated above, the "black-to-white" density ratio of the image has a considerable impact on the ink consumption during a run and the impact of this factor is of course all the more important during long run stencil duplicating when the ink losses due to stencil changing become less significant with respect to the total ink losses due to both stencil changing and printing. It is equally important that the distribution of the ink along the duplicator cylinders 1 and 2 be controlled for optimum results and we therefore propose to provide a more sophisticated version of the control system illustrated in the drawing in which the single sensing roller 8 is replaced by two or more (preferably three) sensing rollers 8. Thus each of these three rollers will sense the ink buildup on a different cylindrical segment along the top cylinder 1 of the duplicator, and with suitable linking of these sensing rollers to the various ink outlets 5 in the distributor 4 it is possible for the ink application at one of the cylindrical regions surveyed to be controlled independently of the ink application at the other two regions surveyed. The possibility of applying ink differentially at various locations along the length of the cylinder may, for example, be achieved by arranging for the ink distributor to consist of an outer sleeve having a configuration much the same as the cylindrical wall of the ink distributor 4, shown in the drawing, and mounted therewithin three separate distribution pipes each one of which feeds only those outlets 5 coincident with a respective one of three distinct cylindrical segments along the length of the lower cylinder 2. Each of these three pipes would be controlled by a flow control valve to prevent ink supply when an "enough ink" signal has been detected by the displacement of the associated sensing finger 12 due to contact with the arm or arms 9 supporting the respective one of the three sensing rollers.

Alternatively, the ink supply along the length of the distributor 4 may come from a single supply pipe conveying it from the pump 7, but the flow of ink may be shut off by rotation of inner sleeves which have ink apertures arranged to coincide with the outlets 5 but only in one rotational position of the inner sleeve. The flow control system for each of the sets of outlets 5 may consist of a mechanism for rotating the appropriate segment sleeve within the ink distributor for bringing the ink apertures of that sleeve into line with the corresponding outlets 5. This rotating mechanism will be operated in response to displacement of the associated switch finger 12.

When, as indicated above, each of the support arms 9 is associated with the sensing finger 12 of a respective one of two switches 13, it is particularly advantageous if the support bearings for the sensing roller 8 are such that the roller 8 may, at least within a limited motion, execute a skewing action with respect to the axis of rotation of the stub shafts 10. In other words, it is an advantage if one of the arms 9 can have an angular orientation different from that of the other so that one of the two arms 9 may contact its associated switch sensing finger 12 whereas the sensing finger 12 of the switch 13 associated with the other arm 9 is not yet contacted. This particular arrangement has the advantage that, in the event of asymmetric inking of the cylinder (for example where one side of the image to be printed is much blacker than the other and consequently ink is withdrawn at a much faster rate from one end of the top cylinder 1, by permeation through that side of the stencil, than it is from the other end and creates a lack of ink on this one end of the cylinder and a surplus of ink on the other end), the fact that the roller 8 skews so that initially only one of the two switches 13 has its sensing finger 12 operated will not necessarily switch off the ink supply completely over the whole cylinder 1.

There are in fact various possibilities of operating using this system.

Firstly, it may be possible to arrange for some means of differential inking so that the ink to one side of the median transverse plane of the cylinder 1 is applied in response to operation of the respective switch 13 at that end of the cylinder and the ink applied to the opposite side is controlled in response to the opposite switch 13. In this way some degree of differential control at various stations along the cylinder can be attained.

A second possibility would be for the ink supply to be effective over the whole length of the cylinder 1 but, bearing in mind that the axially oscillating movement of the inking roller 6 tends to distribute the surplus of ink along the cylinder from the "other" end to the "one" end, to use the independent operation of the two switches 13 to average out the quantity of ink on the surface of the cylinder 1. For example, the ink shut-off signal may be arranged to occur only when both switches 13 are engaged by the respective support arms 9, and/or the ink flow restoration signal may only arise when both switches 13 are released, so that tripping of one switch, or release of one switch, before the other may fail to affect the "on-off" state of the ink supply.

Figure 4:
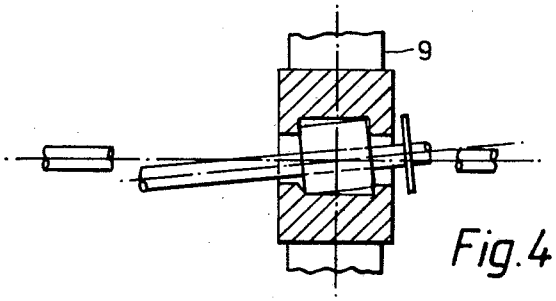
FIG. 4 is a detail of one shaft of FIG. 3.

The freedom of the sensing roller 8 to skew need only be very limited and may be afforded either by a slight looseness in the bearings for the sensing roller 8 (as shown in FIG. 4) or by a torsional deformation capability of each arm 9 which must of course be sufficiently rigid to resist bending moments about the axis of rotation of the stub shafts 10 but could be torsionally resilient with regard to deformation about a longitudinal axis of the arm 9 which intersects both the common axis of stub shafts 10 and the axis of sensing roller 8. In practice as little as 3° of skew misalignment will be sufficient to allow for the required degree of differential control.

The advantage which this variation has over a completely rigid version of the apparatus is that whereas, with the rigid form of support for the sensing roller 8, any sudden fluctuation in the quantity of ink on one side of the cylinder will immediately influence the positioning of the support arms 9 before the oscillating inking roller 6 has a chance to disperse the localised surplus of deficiency, the "skewable sensing roller" system will allow for early switching reaction at one end of the sensing roller 8 where the build-up of ink is higher, without necessarily disturbing the equilibrium state at the opposite end of the roller 8 where the ink layer is thinner. This early switching reaction may manifest itself as a signal to shut off ink to that end of the top cylinder 1, or it may be ineffective to make any change where a single inking means operates simultaneously across the whole cylinder 1 until the second switch 13 also trips; (in this latter case the two switches are effective in much the same way as an AND logic gate).

When the bearings of the sensing roller 8 in arms 9 preclude skewing, the roller 8 remains parallel to duplicator cylinder 1 and only one switch 13, operating on either one of the two arms 9, is needed.

By way of example, one cycle of operation of the duplicator of FIG. 1 will now be described, starting from the "new machine" configuration where there is no ink present on the duplicator cylinders.

Initially, with no ink present, the ink sensing roller 8 will be lying on the surface of the inking roller 6. In fact, this same configuration will exist whenever the machine is shut down and the gravity biasing effect of the weight of the arms 9 and sensing roller 8 drags the sensing roller 8 down along its path towards the inking roller 6. Initially, before any ink is applied from the distributor, the sensing roller 8 will simply be rotated by frictional contact with the inking roller 6 an this will have the effect of cleaning the surface of the sensing roller 8. There will be no tendency for the sensing roller 8 to rise along its path and consequently the switch finger 12 will not be contacted and there will be a constant "ink required" signal to the pump 7 which then supplies the ink distributor 4 for dispensing of the ink through its outlets 5 onto the surface of the lower cylinder 2.

As the thickness of ink on the two cylinders builds up, the situation will eventually arise where the thickness of ink on the upper cylinder 1 will have filled the nip between the sensing roller 8 and the upper duplicator cylinder 1. It is envisaged that this nip will be of the order of 0.005 inches under normal working conditions.

At this point, a further application of ink will cause the ink film on the upper duplicator cylinder 1 to build-up to start a wedge similar to the ink wedge 19 shown in the drawing. As this wedge builds up it will eventually have enough resistance, to passage through the nip between the sensing roller 8 and the upper duplicator cylinder 1, for it to lift the sensing roller 8 away from contact with the inking roller 6 and to cause the two support arms 9 to move in the clockwise direction about the coaxial stub shafts 10. Because the axis of each stub shaft 10 is close to or adjacent the axis of upper duplicator cylinder 1 (i.e. much closer to its axis than to its periphery), as the arms 9 move in this direction they will bring the sensing roller 8 slightly further away from the surface of the upper cylinder 1, in other words they will increase the width of the nip between the roller 8 and cylinder 1, due to the eccentric positioning of the stub shafts 10 with respect to the axis of rotation 11 of the upper duplicator cylinder 1. However, ink will continue to be applied to the lower cylinder 2 until the arm or arms 9 can contact the switch finger 12, so the wedge 19 will continue to build up to overcome this increasing gap effect.

Once the arm 9 reaches the position 9', the switch finger 12 will be displaced upon further movement of the sensing roller 8 and, provided this is more than a mere transient displacement of the arm 9, the pump 7 will be disenabled, in this case by interruption of the electric power supply to the pump 7.

Ink will continue to be consumed by the normal printing operation of the duplicator and then, in turn, the wedge 19 will become dissipated gradually onto the surface ink film on the upper cylinder 1. As the wedge is dissipated, the sensing roller 8 will move in the anticlockwise direction about its arcuate path to approach the inking roller 6.

However, when the arm 9 releases the switch finger 12 the ink pump 7 will once again be energised and the ink flow from distributor 4 will restart. Until the additional ink has a chance to work its way through the system and to arrive back at the wedge 19, there will be a gradual consumption of the ink wedge 19 allowing the roller to move still further in the anticlockwise direction and it may even eventually come into rolling contact with the inking roller 6 which will, by virtue of this rolling contact, clear any longitudinal ridges of ink from the surface of the sensing roller 8 to ensure that when next the wedge 19 builds up there will be a completely uniform ink build-up on the sensing roller 8. This has the effect of reducing the tendency for transient displacements of the sensing roller 8, by eliminating ridges of ink extending along the roller 8.

Once the wedge 19 builds up again to the required value, the sensing roller 8 will again be driven in the clockwise direction until it displaces the finger 12 to shut down once again the supply of ink. This long period oscillation of the arms 9 will continue and will maintain on the surface of the upper cylinder 1 an ink layer whose thickness is approximately constant and is in any case within desired limits. This thickness can, as indicated above, be related to the quantity of ink on the lower cylinder 2 and the ink screen 3 and the stencil carried thereby.

Additional adjustability may be incorporated by adjustment of the positioning of the stub shafts 10 about the axis of rotation 11 of the upper duplicator cylinder 1. Although the radius of eccentricity is constant, in that the shafts 10 are eccentrically mounted on a carrier, 38 (FIG. 3), by rotating the carrier about the axis 11 using lever 39 (FIG. 3) it is possible to change the values for the gap between the sensing roller 8 and the upper cylinder 1 in the "rest" position and in the "enough ink" position (when the arm 9 is in the position 9').

Furthermore, it is envisaged that the switch 13 may be adjustably positioned on the machine so as to vary the length of the arcuate path between the "rest position" and the position 9' of the arm 9.

Although in the embodiment illustrated in FIG. 1 there is an electric ink pump which is disenabled when the switch sensing finger 12 is displaced, it is alternatively possible to incorporate the conventional manual positive displacement pump for ink supply and to provide a pump-disenabling solenoid which is electrically actuated when the switch finger 12 is displaced. For example, in such a pump it is possible for a piston pump to have its piston rod driven by rotation of a puller mechanism and for this puller mechanism to be displaced out of the path of the piston rod by energisation or de-energisation of the solenoid.

Figure 2:
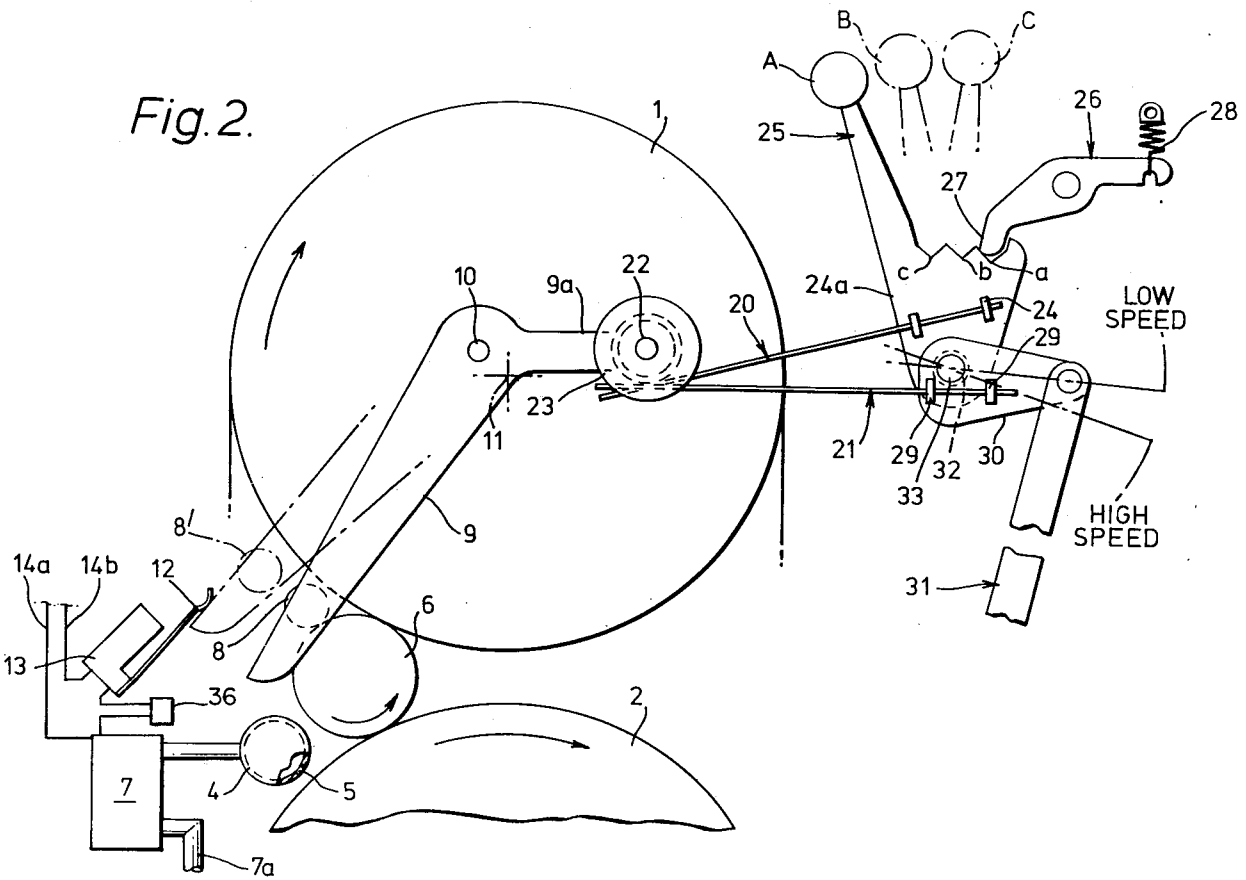
FIG. 2 is a view similar to FIG. 1 but showing an alternative embodiment of the duplicator in accordance with the present invention.

An alternative embodiment of the stencil duplicator in accordance with the present invention is illustrated in FIG. 2 where many of the components are identical to those shown in FIG. 1 and are hence allotted the same reference numerals. The difference in the system of FIG. 2 is concerned with the means for variably biasing the arms 9 for rotation about the common axis of stub shafts 10.

Thus, in FIG. 2, the helical tension spring 15 and the support bracket 17*a* have been replaced by a pair of independent wire springs 20 and 21 at each end of the cylinder 1. At each end of the cylinder these two springs act independently on a rightwardly projecting counterbalancing portion 9*a* of each of the respective support arm supporting a respective pin 22 having disc-shaped counterweights 23 at each end. The counterweights 23 serve to locate the two springs 20 and 21 at the end of the cylinder to ensure that they do not slide along the longitudinal direction of pins 22 by any greater extent than is necessary.

Because of the counterbalancing effect of the portions 9*a* of the support arms 9, and of the pins 22 and the counterbalance weights 23, giving more accurate ink thickness control at low duplicator operating speeds, the spring effort in the FIG. 2 embodiment is required to assist in lowering the sensing roller 8 towards the inking roller 6 rather than raising it.

Each spring 21 is carried by two lugs 24 mounted on a respective carrier plate 24*a*. One of the plates 24*a* includes a manual control lever 25 having a handle which can be moved from its full-line position A to the alternative broken-line position B or C to rotate a tubular connecting spindle 32 which carries the two carrier plates 24*a*, thus causing the spring 20 to become strained flexurally and exert a greater restoring force on the arms 9 to bring the sensing roller 8 towards the inking roller 6. It will be appreciated that the springs 20 hold the sensing roller 8 down nearer to the inking cylinder 6 (thereby delaying to a greater extent the onset of switch engagement by support arm 9) when the handle of lever 25 is in position C than it does when the handle is in position B.

The three positions A, B and C of the handle on the control lever 25 thus illustrate three alternative settings for the equilibrium position of the sensing roller 8 and hence they define, in effect, three separate equilibrium values for the ink layer thickness on cylinder 1.

The selected position of the control lever 25 is held by a retaining pawl 26 having a tip 27 capable of engagement in any one of three separate notches a, b and c which correspond to the positions A, B, C (respectively) of the handle of the lever 25. The pawl 26 is biased in the anticlockwise direction by a helical tension spring 28 to hold the pawl tip 27 in the associated notch (a, b or c).

At any time during operation of the duplicator (even when the machine is in normal printing operation) it is possible for the operator to shift the control lever 25 to a different position and thereby instantaneously to select a new equilibrium value for the ink layer thickness, which new value will be maintained by the various elements of the ink layer controlling device shown in FIG. 2.

Each alternative wire spring 21 is carried by two lugs 29 of a respective carrier plate 30, one of which plates is connected by way of a link 31 to the speed select linkage of the duplicator. The link 31 may either be an active part of the normal mechanism which moves when a change in the speed of rotation of the duplicator cylinders 1 and 2 is selected, or alternatively it may be an additional link connected to one of the components of that linkage. The two carrier plates 30 are fixed to a connecting spindle 33 coaxially within the connecting tube 32 so they both adopt the same angular orientation in response to movement of the link 31.

As shown in FIG. 2, the carrier plates 30 have two extreme positions, one indicated by the wording "low-speed" and the other indicated by the wording "high-speed", such that (for any given desired ink layer thickness on the cylinder 1) in the "high-speed" position of plates 30 the flexural strain in the springs 21 is greater than it will be in the "low-speed" position and thus the additional effort contributed by the flexural strain in springs 21 helps to overcome the increased drag on the sensing roller 8, resulting from the increased peripheral speed of the cylinder 1 past the sensing roller 2 giving an apparently "stiffer" quality to the "viscous drag" yieldability of the ink layer on the cylinder 1. The desired reduction of the flexural strain in the spring 21 for the "low-speed" position is clearly understood from this explanation.

Naturally, although the two extreme positions are shown in FIG. 2, any number of intermediate positions of the orientation of the carrier plates 30 is possible within those two extremes.

As a full description of the operating sequence of the machine has been given above with reference to FIG. 1, no similar detailed explanation is needed with regard to FIG. 2, except to say that the automatic compensation for the change in speed of the duplicator is achieved without any interference between the speed-responsive controlling action and the manually-selected ink thickness layer. Equally, in the FIG. 2 embodiment the operator has a simple "click-stop" control lever 25 enabling selection of the required level of inking on the cylinder 1 again completely independently of any speed-responsive compensation.

Where, as indicated above as a possible modification of FIG. 1, the mountings for the sensing roller 8 are such as to permit a certain amount of skewing of the sensing roller to respond to differential thicknesses of the ink layer at different ends of the stencil cylinder 1, it may be advantageous to make the two carrier plates 24*a* independently movable and give them both a control lever 25 so that the level of inking at opposite ends of the printing cylinder 1 can be selected independently. This may, for example, be achieved by mounting at least one of the carrier plates 24*a* rotatably on the tube 32 or by dispensing with the connecting tube and instead mounting the two carrier plates 24*a* rotatably on the spindle 33. Thus the spring 20 at one end of the cylinder can be given a different flexural stress than the spring 20 of the opposite end of the cylinder so that, where differential application of ink is envisaged, the same sensing roller 8 can be both capable of restoring the ink level to the desired level and responding to a locally desired ink level which may be different from that desired at the other end of the printing cylinder 1.

I claim:

1. In a twin-cylinder stencil duplicator including first and second cylinders each rotatable about a respective axis, an ink screen mounted on said first and second cylinders to carry a stencil for ink transfer between the surface of the first cylinder and the stencil by way of said ink screen, first and second ends to said first cylinder, and means for applying ink to the surfaces of said first and second cylinders; the improvement comprising means for automatically controlling the quantity of ink on said first cylinder, said last-mentioned means including:

(a) sensing roller means positioned adjacent the surface of said first cylinder and having first and second ends;

(b) means mounting said sensing roller means adjacent said first cylinder, said mounting means being effective to constrain each of the first and second ends of said sensing roller means for movement to and fro along a predetermined respective arcuate path which extends simultaneously both in a peripheral direction of the said first cylinder and radially of the first cylinder and is concave on its side facing the said axis of the first cylinder, said predetermined respective arcuate paths for said first and second ends of said sensing roller means being arranged so that said sensing roller means remains inwardly of said ink screen and radially outwardly of said first cylinder but out of contact therewith to contact instead a layer of ink on said first cylinder in use of the duplicator; and (c) means responsive to movement of said first and second ends of said sensing roller means along said predetermined respective arcuate paths and effective to control ink supply from said ink applying means.

2. In a twin-cylinder stencil duplicator including first and second cylinders each rotatable about a respective axis, an ink screen mounted on said first and second cylinders to carry a stencil for ink transfer between the surface of the first cylinder and the stencil by way of said ink screen, first and second ends to said first cylinder, and means for applying ink to the surfaces of said first and second cylinders; the improvement comprising means for automatically controlling the quantity of ink on said first cylinder, said last-mentioned means including:

(a) sensing roller means positioned adjacent the surface of said first cylinder and having first and second ends;

(b) means mounting said sensing roller means adjacent the said first cylinder, said mounting means being effective to constrain each of the first and second ends of said sensing roller means for movement to and fro along a predetermined respective circular arcuate path centered on a point which is adjacent but eccentric with respect to the axis of rotation of said first cylinder, each of said predetermined respective arcuate paths extending simultaneously both in a peripheral direction of said first cylinder and radially of said first cylinder and being concave on its side facing the said axis of rotation of the first cylinder, said predetermined respective arcuate paths for said first and second ends of said sensing roller means being furthermore arranged so that said sensing roller means remains inwardly of said ink screen and radially outwardly of said first cylinder but out of contact therewith to contact instead a layer of ink on said first cylinder in use of the duplicator; and (c) means responsive to movement of said first and second ends of said sensing roller means along said predetermined respective arcuate paths and effective to control ink supply from said ink applying means.

3. A stencil duplicator according to claim 2, wherein said means mounting said sensing roller means adjacent said first cylinder comprise: (a) support arms (b) means mounting said support arms at said first and second ends of the first cylinder for rotation about a pivot axis passing through said eccentric point, and (c) first and second carriers for said last means, said carriers being rotatable to vary the position of said pivot axis orbitally about said rotation axis of the first cylinder.

4. A stencil duplicator according to any one of claims 3, 1 or 2, wherein said means for applying ink to the surface of said first cylinder comprise an ink pump, and an ink distributor connected to said pump; and wherein said means responsive to movement of said sensing roller means to control ink supply from said ink applying means includes means for rendering said ink pump one of operative and inoperative in response to movement of said first and second ends of said sensing roller means along said predetermined respective arcuate paths.

5. A stencil duplicator according to any one of claims 3, 1 or 2, and including a spring biasing means operative to urge said sensing roller means in one direction along said path.

6. A stencil duplicator according to claim 5, wherein said spring biasing means includes adjustor means for adjusting the spring force exerted on said sensing roller means.

7. A stencil duplicator according to claim 6, wherein said duplicator includes variable speed drive means and a speed select mechanism for selecting a desired speed, and wherein said adjustor means for adjusting the spring force includes linkage means connecting said spring biasing means to said speed control mechanism for altering said spring force in response to an altered selected rate of rotation of said first cylinder.

8. A stencil duplicator according to claim 6, wherein said adjustor means for adjusting the spring force includes manually operable control means operable to vary the automatically controlled quantity of ink on said first cylinder.

9. A stencil duplicator according to claim 8, wherein said spring biasing means comprise first and second biasing spring means at said first and second ends of said first cylinder respectively, and said adjustor means comprise first and second manually operable controls each associated with a respective one of said first and second spring means.

10. A stencil duplicator according to any one of claims 3, 1 or 2, and including means for rendering said means responsive to movement operative only in response to sustained attainment of a condition indicating one of sufficient ink and insufficient ink on said first cylinder.

11. A stencil duplicator according to claim 10, wherein said means responsive to movement of said sensing roller means comprises an electrical sensor, and said means for rendering the ink control operative only in response to sustained attainment of a condition indicating one of sufficient ink and insufficient ink comprises an electrical time delay mechanism for ensuring that said ink pump is rendered one of operative and inoperative, respectively, only if after a predetermined time delay from attainment of one of an "insufficient ink" and "sufficient ink" signal the respective signal is still present.

12. A stencil duplicator according to claim 10, wherein aid means for rendering said means responsive to movement operative only in response to sustained attainment of a condition indicating one of sufficient ink and insufficient ink comprises mechanical damper means resisting fluctuating movement of said sensing roller means.

13. A stencil duplicator according to any one of claims 3, 1 or 2, wherein said means for supplying ink to the surface of said first and second cylinders is effective to apply ink directly to said second duplicator cylinder, and wherein said ink sensing roller means is responsive to build-up of ink on said first cylinder.

* * * * *